US009689632B2

(12) United States Patent
Hawkins

(10) Patent No.: US 9,689,632 B2
(45) Date of Patent: Jun. 27, 2017

(54) INTEGRAL SPRING BOTTOM METAL LATCH

(71) Applicant: Hawkins Precision LLC, Colorado Springs, CO (US)

(72) Inventor: Andrew Hawkins, Colorado Springs, CO (US)

(73) Assignee: Hawkins Precision LLC, Colorado Springs, CO (US)

( * ) Notice: Subject to any disclaimer, the term of this patent is extended or adjusted under 35 U.S.C. 154(b) by 64 days.

(21) Appl. No.: 14/705,962

(22) Filed: May 6, 2015

(65) Prior Publication Data

US 2015/0354911 A1 Dec. 10, 2015

Related U.S. Application Data

(60) Provisional application No. 61/989,402, filed on May 6, 2014.

(51) Int. Cl.

| | |
|---|---|
| ***F41A 9/59*** | (2006.01) |
| ***F41A 3/66*** | (2006.01) |
| ***F41A 9/82*** | (2006.01) |
| ***F41A 17/38*** | (2006.01) |

(52) U.S. Cl.

CPC *F41A 9/59* (2013.01); *F41A 3/66* (2013.01); *F41A 9/82* (2013.01); *F41A 17/38* (2013.01)

(58) Field of Classification Search

CPC .... F41A 17/38; F41A 9/59; F41A 9/61; F41A 11/00

See application file for complete search history.

(56) References Cited

U.S. PATENT DOCUMENTS

| | | | | | |
|---|---|---|---|---|---|
| 667,856 | A * | 2/1901 | Wagner et al. | F41A 9/65 | 42/50 |
| 747,777 | A * | 12/1903 | Ross et al. | F41A 17/38 | 42/18 |
| 1,290,845 | A * | 1/1919 | Redfield et al. | F41A 17/38 | 42/18 |
| 2,745,203 | A * | 5/1956 | Ruple | F41A 9/65 | 42/18 |
| 2,997,803 | A * | 8/1961 | Florence | F41A 9/70 | 42/18 |
| 3,235,994 | A * | 2/1966 | Grippo | F41A 17/38 | 42/50 |
| 3,415,000 | A * | 12/1968 | Koucky | F41A 17/38 | 42/18 |
| 3,803,739 | A * | 4/1974 | Haines | F41A 17/38 | 42/50 |
| 4,237,638 | A * | 12/1980 | Trexler | F41A 11/02 | 42/6 |

(Continued)

FOREIGN PATENT DOCUMENTS

| | | | | |
|---|---|---|---|---|
| DE | 2618074 A1 * | 11/1977 | | F41A 17/38 |

*Primary Examiner* — Benjamin P Lee
(74) *Attorney, Agent, or Firm* — Lewis Roca Rothgerber Christie LLP

(57) ABSTRACT

An integrated spring bottom metal latch is disclosed that obviates the problem of rifles having heavy recoil from erroneously and unintentionally opening and dropping shells or magazines upon firing. The integrated spring allows for exact manufacturing versus compression springs. As a result, the presently disclosed invention may be utilized to address specific recoil requirements as found in any number of rifles exhibiting different recoil.

15 Claims, 2 Drawing Sheets

(56) References Cited

U.S. PATENT DOCUMENTS

| | | | | | |
|---|---|---|---|---|---|
| 4,450,641 | A * | 5/1984 | Bullis | F41A 9/65 | 42/18 |
| 4,815,226 | A * | 3/1989 | Ruger | F41A 9/65 | 42/6 |
| 4,947,730 | A * | 8/1990 | Byron | F41A 5/24 | 89/146 |
| 5,351,428 | A * | 10/1994 | Graham | F41C 23/04 | 42/106 |
| 5,685,101 | A * | 11/1997 | Ferretti | F41A 9/65 | 42/18 |
| 5,899,013 | A * | 5/1999 | Hauser | F41A 17/38 | 42/6 |
| 8,122,632 | B2 * | 2/2012 | Bentley | F41A 9/65 | 42/6 |
| 8,191,298 | B2 * | 6/2012 | Cash | F41A 9/65 | 42/49.02 |
| 8,434,253 | B2 * | 5/2013 | Cain | F41A 17/38 | 42/49.01 |
| 2015/0377574 | A1 * | 12/2015 | Cooke | F41A 17/063 | 42/70.11 |

* cited by examiner

INTEGRAL SPRING BOTTOM METAL LATCH

CROSS-REFERENCE TO RELATED APPLICATIONS

The present application claims the priority benefit of U.S. provisional application No. 61/989,402 filed May 6, 2014 and entitled "Integral Spring Bottom Metal Latch," the disclosure of which is incorporated herein by reference.

BACKGROUND OF THE INVENTION

Field of the Invention

The present invention generally relates to gunstock floor plates. More specifically, the present invention relates to the release of a floor plate or magazine in the bottom metal assembly of a gunstock floor plate.

Description of the Related Art

The gunstock of a rifle is that part of the rifle to which to which the barrel and firing mechanism are attached. Also coupled to or integrated with the stock is the floor plate. Floor plates are well known in the art and operate to close the bottom of the magazine recess in a bolt-action rifle having a clip-loaded magazine.

One type of floor plate is the hinged floor plate. A hinged floor plate is a floor plate that swings open but remains attached to the rifle such as might be found in a Remington 700 rifle. Cartridges are loaded with the bolt in the open position and pushed down into the magazine-well area of the stock. To unload the cartridges, a switch or button located by the trigger is actuated to allow the bottom of the action to open and dispense unused cartridges.

Some rifle floor plate designs allow for a clip magazine to be mounted to a hinged floor plate. Cartridges are loaded into a clip that can be inserted into the stock and removed by actuating a switch or button as described above. Such a design is sometimes referred to as a drop box, a detachable magazine, or a detachable box magazine.

Recoil is the backward momentum of a rifle during discharge of a projectile. Recoil results when a rifle balances the forward momentum of a projectile and exhaust in accordance with Newton's Third Law of Motion (i.e., all forces exist in pairs). Rifles with hinged floor plates (or floor plates allowing for introduction of a drop box or detachable magazine) and that have heavy recoil will often cause the trigger finger of a shooter to unintentionally come into contact with the aforementioned switch or button of the floor plate. The heavy recoil of the rifle coupled with the unintentional contact results in actuation and a resulting opening of the action, which dispenses unused cartridges.

This unintentional recoil contact, actuation, and dispensing of cartridges or release of a drop box or clip can be an inconvenient annoyance. Cartridges or clips can be lost or damaged as a result of the unintentional and unwanted opening of the action. Collection and reinsertion of the unintentionally dispensed cartridges interrupts a shooting experience, which can lessen the enjoyment of the shooter or result in a missed shooting opportunity. Some shooters may, however, be involved in big game hunting (e.g., large game such as elephants or other African game). If the action opens and dispenses cartridges following ejection of a projectile, the now injured and unquestionably startled game could elect to attach the shooter causing severe injury—or death—as the shooter attempts to recollect and reintroduce unintentionally dispenses ammunition.

There is a need in the art to solve the problem of those rifles having hinged floor plates and heavy recoil from erroneously ejecting cartridges as a result of unintentional trigger finger contact following firing.

SUMMARY OF THE PRESENTLY CLAIMED INVENTION

In a first claimed embodiment, an integral spring bottom metal latch system is claimed. The system includes a latch body with a through hole and movement arm. The system further includes a spring that operates as resistance to release of a floor plate of magazine in a bottom metal assembly. A catch holds the floor plate or magazine in place.

An integral spring bottom metal latch system is also claimed in a second embodiment. The second claimed embodiment includes a bottom metal assembly and integral spring that operates as a primary resistance to the release of a floor plate in the bottom metal assembly.

A third claimed embodiment recites a further integral spring bottom metal latch system. The system includes a bottom metal assembly and integral spring that operates as a primary resistance to the release of a magazine in the bottom metal assembly.

DETAILED DESCRIPTION

The integral spring bottom metal latch of the presently disclosed invention represents an improvement to prior art bottom metal latches and corresponding floor plate systems. The integral spring bottom metal latch of the presently disclosed invention includes a spring that operates as the primary resistance to the release of the floor plate or magazine in the bottom metal assembly. The bottom metal assembly is the trigger guard and magazine system in a bolt action rifle.

By integrating the spring into the metal latch assembly, the spring may exhibit higher strength than compression springs as found in prior art floor plate systems. The integrated spring, too, may be tooled and manufactured to address the specific recoil requirements of a specific rifle design. The presently disclosed integral spring bottom metal latch may be utilized in both a hinged floor plate and detachable box magazine design.

Figure 1:
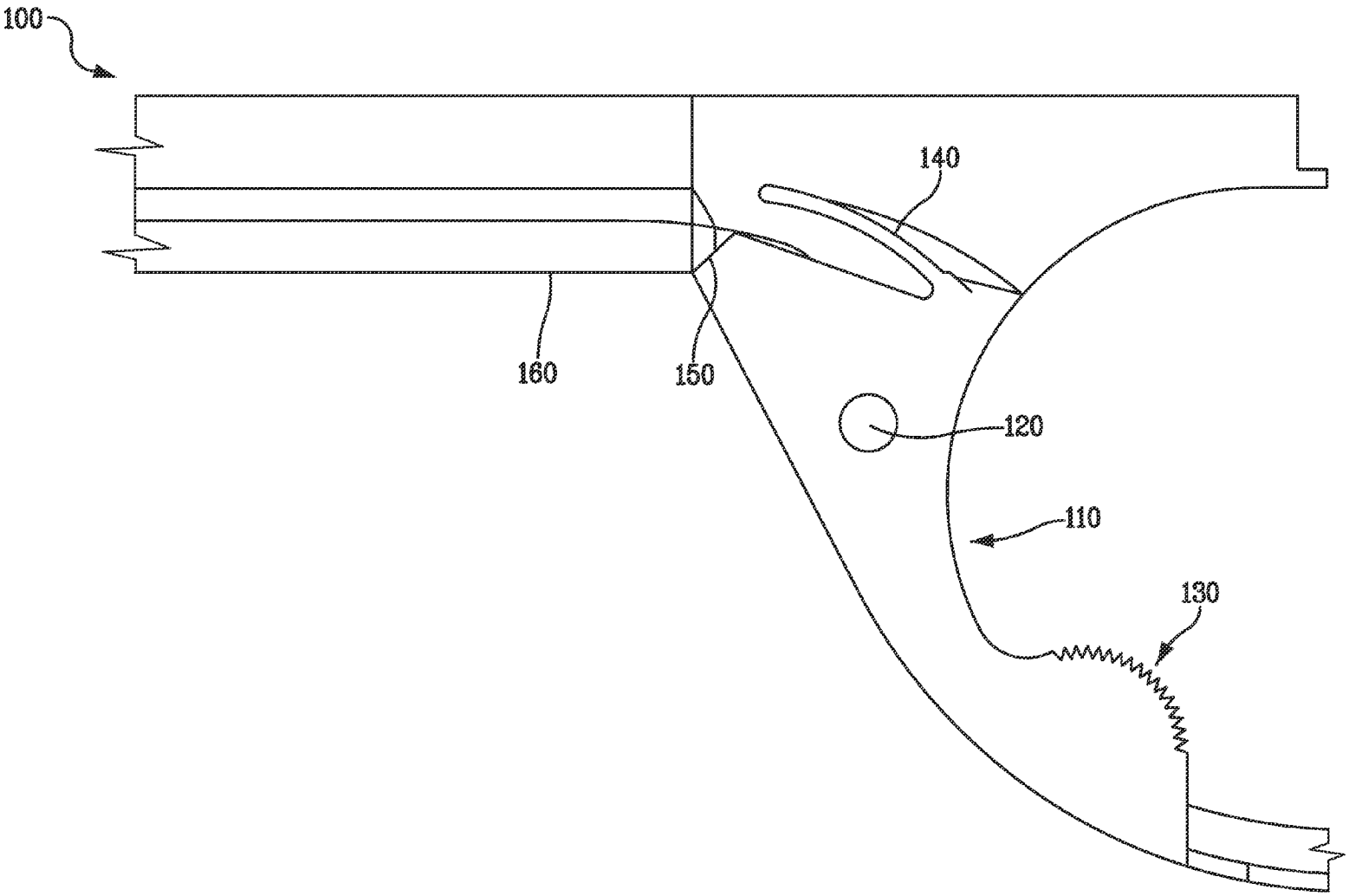
FIG. 1 illustrates an integral spring bottom metal latch system in a rifle with a hinged floor plate.

FIG. 1 illustrates an integral spring bottom metal latch system 100 in a rifle with a hinged floor plate. The system 100 of FIG. 1 includes a latch body 110 having a through hole and movement arm 120. The system 100 of FIG. 1 also includes exposed button 130 and a thin, webbed, integrated spring 140. The spring may be curved, straight, tapered, or reverse tapered. The spring may be one piece or multiple components having different lengths and different tension. The spring may also be parallel or of a convex, or concave configuration. The spring may be integrated or attached to other components. In an alternative embodiment, the spring may be of a cantilever design. System 100 also includes a catch 150 that holds the floor plate 160 in place.

When the button 130 is pressed in system 100 of FIG. 1, the catch 150 is rotated about the through hole 120. The rotation compresses the thin, webbed, integrated spring 140.

As a result of the aforementioned compression, the floor plate 160 is released thereby allowing shells to drop out. The design of the system 100 of FIG. 1 prevents a rifle with a hinged floor plate and heavy recoil from allowing the trigger finger of a shooter to unintentionally come into contact with the switch or button allowing for release of the floor plate and erroneously releasing ammunition from the rifle.

Figure 2:
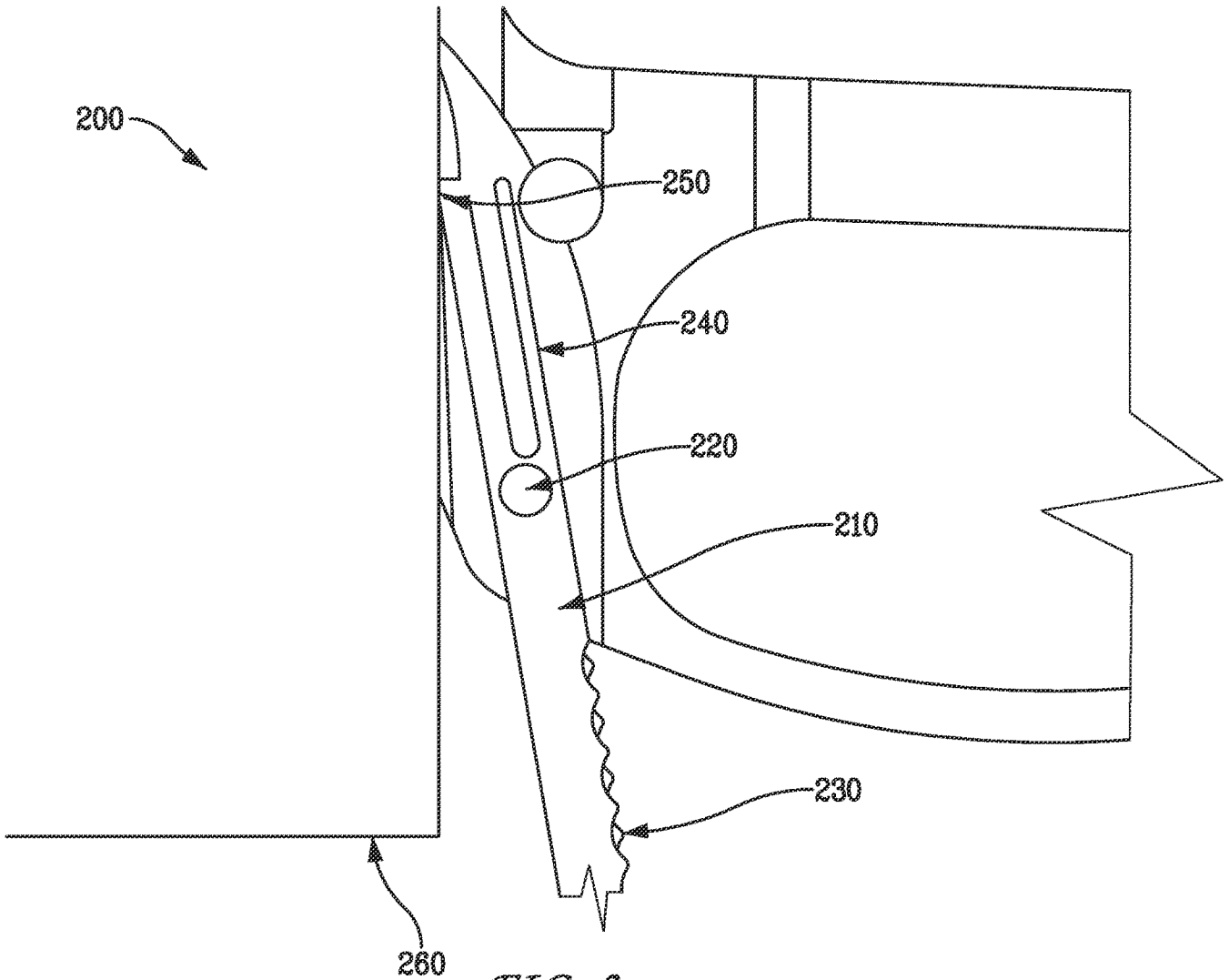
FIG. 2 illustrates an integral spring bottom metal latch system in a rifle with detachable box magazine system.

FIG. 2 illustrates an integral spring bottom metal latch system 200 in a rifle with detachable box magazine system. The system of FIG. 2 is similar to the system 100 of FIG. 1. The system 200 of FIG. 2 includes a latch body 210 having a through hole and movement arm 220. The system 200 of FIG. 2 also includes exposed button 230 and a thin, webbed, integrated spring 240. The spring may be curved, straight, tapered, or reverse tapered. The spring may be one piece or multiple components having different lengths and different tension. The spring may also be parallel or of a convex, or concave configuration. The spring may be integrated or attached to other components. In an alternative embodiment, the spring may be of a cantilever design. System 200 also includes a catch 250 that holds the magazine 260 in place.

When the button 230 is pressed in system 200 of FIG. 1, the catch 250 is rotated about the through hole 220. The rotation compresses the thin, webbed, integrated spring 240. As a result of the aforementioned compression, the magazine 260 is released thereby allowing cartridges to drop out. The design of the system 200 of FIG. 2 prevents a rifle with a hinged floor plate and heavy recoil from allowing the trigger finger of a shooter to unintentionally come into contact with the switch or button allowing for release of the magazine and erroneously releasing a cartridge from the rifle.

While various embodiments of the presently disclosed invention have been described above, it should be understood that they have been presented by way of example only, and not limitation. The description are not intended to limit the scope of the presently claimed invention or to limit the scope of embodiments of the presently claimed invention. The present descriptions are intended to cover alternatives, modifications, and equivalents consistent with the spirit and scope of the disclosure.

What is claimed is:

1. A one piece integral spring bottom metal latch for a firearm bottom metal assembly comprising:

a latch body including a through hole portion and a movement arm portion;

a spring portion that operates as a primary resistance to release of a floor plate or magazine in the firearm bottom metal assembly; and a catch portion that holds the floor plate or magazine in place, wherein rotation of the movement arm portion about the through hole portion compresses the spring portion towards the movement arm portion to disengage the catch portion from the floor plate or magazine.

2. The latch of claim 1, wherein a strength of the spring portion corresponds to a recoil of a firearm incorporating the latch.

3. The latch of claim 1, wherein the spring portion is curved.

4. The latch of claim 1, wherein the spring portion is straight.

5. The latch of claim 1, wherein the spring portion is tapered.

6. The latch of claim 1, wherein the spring portion is reverse tapered.

7. The latch of claim 1, wherein the spring portion is parallel to the movement portion.

8. The latch of claim 1, wherein the spring portion is concave.

9. The latch of claim 1, wherein the spring portion is of a cantilever design.

10. The latch of claim 1, wherein the latch further comprises a button portion, wherein depressing the button portion moves the movement arm portion.

11. A firearm bottom metal latch system, the system comprising:

a bottom metal assembly; and a one piece integral spring latch that operates as a primary resistance to the release of a floor plate or a magazine in the bottom metal assembly, the one piece integral spring latch comprising:

a latch body including a through hole portion and a movement arm portion;

a spring portion, and a catch portion that engages the floor plate or the magazine, wherein rotation of the movement arm portion about the through hole portion compresses the spring portion towards the movement arm portion to disengage the catch portion from the floor plate or magazine.

12. The system of claim 11, wherein a strength of the spring portion corresponds to a recoil of a firearm incorporating the bottom metal latch system.

13. The system of claim 12, wherein the floor plate is hinged.

14. The system of claim 11, wherein the magazine is a box magazine.

15. The system of claim 14, wherein the box magazine is detachable.

* * * * *